US007252534B2

(12) United States Patent
Reibke

(10) Patent No.: US 7,252,534 B2
(45) Date of Patent: Aug. 7, 2007

(54) ELECTRICAL CONNECTION ARRANGEMENT WITH SIMPLIFIED FASTENING DEVICE FOR ELECTRICAL CONNECTION OF AN ELECTRICAL DEVICE

(75) Inventor: Heinz Reibke, Bad Salzuflen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 11/468,885

(22) Filed: Aug. 31, 2006

(65) Prior Publication Data

US 2007/0049104 A1 Mar. 1, 2007

(30) Foreign Application Priority Data

Sep. 1, 2005 (DE) ..... 10 2005 041 778

(51) Int. Cl.
*H01R 4/24* (2006.01)

(52) U.S. Cl. ..... 439/404; 439/709; 439/834; 439/791; 439/765

(58) Field of Classification Search ..... 439/404, 439/709, 834, 835, 786, 787, 765, 791, 801, 439/803, 810, 815, 806
See application file for complete search history.

(56) References Cited

U.S. PATENT DOCUMENTS 4,118,095 A * 10/1978 Berglund et al. ..... 439/403
4,175,822 A * 11/1979 Debaigt ..... 439/625
4,262,985 A * 4/1981 Muehlhausen, II ..... 439/401
5,147,218 A * 9/1992 Matthews et al. ..... 439/404
5,314,350 A * 5/1994 Matthews et al. ..... 439/404
5,498,172 A * 3/1996 Noda ..... 439/404
5,498,173 A * 3/1996 Drewanz et al. ..... 439/404
5,722,850 A * 3/1998 White ..... 439/404
6,368,128 B1 4/2002 Backer et al.
6,663,441 B1 12/2003 Alexandre et al.

FOREIGN PATENT DOCUMENTS

DE 10163809 A1 7/2003
DE 102 32 281 A1 2/2004
FR 2600831 * 12/1987
GB 2342933 A 4/2000

* cited by examiner

*Primary Examiner*—Tho D. Ta
(74) *Attorney, Agent, or Firm*—David S. Safran

(57) ABSTRACT

An electrical connection arrangement for electrical connection of an electrical device with a bottom part for holding at least one device-side cable, with a top part for holding at least one connection-side cable and with a contact body for electrical connection of the device-side cable to the connection-side cable, the bottom part and the top part being formed essentially of an electrically insulating material. The connection is improved in that at least one fastening device for fastening at least one device-side cable is formed in the bottom part, that the contact body is located in the top part and has a first contact device and a second contact device, and that, in the joined position of the bottom part to the top part, the contact body makes contact with the device-side cable with the first contact device and makes contact with the connection-side cable with the second contact device.

9 Claims, 10 Drawing Sheets

ELECTRICAL CONNECTION ARRANGEMENT WITH SIMPLIFIED FASTENING DEVICE FOR ELECTRICAL CONNECTION OF AN ELECTRICAL DEVICE

BACKGROUND OF THE INVENTION

1. Field of the Invention

The invention relates to an electrical connection arrangement for electrical connection of an electrical device, especially an electric motor, with a bottom part for holding at least one device-side cable, with a top part for holding at least one connection-side cable and with a contact body for electrical connection of the device-side cable to the connection-side cable, the bottom part and the top part being formed essentially of an electrically insulating material.

2. Description of Related Art

Electrical connection arrangements of the type under consideration are known and are used for quite different contact-making and connection purposes. From plant construction for example terminal blocks are known which are designed conventionally for top-hat rail installation in a switching cabinet and consist of a bottom part and a top part (Phoenix Contact product catalog, COMBICON® Circuit board connection, 2000/01, pages 198-212). After the lower part of the connection arrangement is locked on, the device-side cable, from which the insulation has been stripped on the end side, is inserted into the bottom part and is electrically connected there to a contact body located in the bottom part by a clamping or screw connection. Connection-side stripped cables are then fastened in or on a contact body made as a push-on terminal strip which is located in the top part. When the top part and the bottom part are moved into the common joined position, at the same time, the contact between the contact body in the top part and the contact body in the bottom part, and thus, a connection between the connection-side and the device-side cable, are produced.

German Patent Application DE 102 32 281 A1 discloses another electrical connection arrangement which, in any case, is tailored to a special application for connecting a cable set to the stator-winding ends of an external-rotor motor. The bottom part of this connection arrangement is intended for mounting on the motor housing, the device-side cable—therefore the motor-side winding ends—being electrically connected to the contact bodies which are located in the bottom part and which are made as insulation piercing contacts; consequently, there is no need for preparatory insulation stripping of the device-side cable ends. The distributed contact bodies extend as far as a plug receiver which is made in the bottom part and into which the top part made as a plug-in terminal strip can be inserted. In the top part, there are, in turn, corresponding contact bodies which can be electrically connected to the connection-side cables. Via plug-in jumpers which can be inserted into the top part, various contact bodies located in the top part can be electrically connected to one another; this is used especially for optional wiring of motor windings into a star or triangle arrangement.

Even if the electrical connection of a device with the above described connection arrangement compared to the first example from the prior art has been simplified as a result of using insulation piercing contacts, the connection process is nevertheless still comparatively complex. In particular, when contact of the device-side cable with the insulation piercing contacts is made, there is the danger of mechanical and electrical damage since, after contact-making of the device-side cable, there is a device-side potential—for example, from a buffer capacitor—on the insulation piercing contacts.

SUMMARY OF THE INVENTION

Therefore, a primary object of the present invention is to provide an electrical connection arrangement with improved and simplified connection properties.

The electrical connection arrangement in accordance with the invention in which this object is achieved is characterized, first of all, essentially in that, in the bottom part, at least one fastening means for fastening at least one device-side cable is formed, that the contact body is located in the top part, that the contact body has a first contact device and a second contact device, and that the contact body in the joined position of the bottom part to the top part, with the first contact device, makes contact with the device-side cable, and with the second contact device, can make contact with the connection-side cable.

The electrical connection arrangement in accordance with the invention is advantageous in many respects. Because the contact body is located in the top part of the connection arrangement, a contact point is omitted relative to the connection arrangements known from the prior art, specifically the contact point between the contact bodies located in the bottom part and in the top part. Furthermore, the contact-making process of the device-side cable becomes much simpler and safer since contact between the contact body and the device-side cable is only produced in the joined position of the bottom part and the top part. Thus, there is neither the danger of mechanical damage on the first contact device which produces the connection, nor the danger of an electrical shock by touching the first contact device which may be energized.

The connection arrangement in accordance with the invention can be further improved with respect to its applicability by the first contact device of the contact body being made as an insulation piercing contact. This has the advantage that the device-side cable can be worked completely insulated and after contact-making by the insulation piercing contacts a safe and vibration-proof electrical connection is produced.

According to other advantageous embodiments of the invention, the second contact device is executed as a spring terminal or screw-type terminal for contact-making of the connection-side cable. In this way, the electrical and mechanical connection of the connection-side cable to the contact body can be easily detached again almost as often as desired, a safe electrical connection still being ensured.

Preferably, the contact body is also made such that it can hold one leg of a plug-in jumper with contact-making so that at least two contact bodies can be electrically connected to one another. In this way, the applicability of the connection arrangement in accordance with the invention for connection of an electric motor is also ensured in order to enable the aforementioned wiring of different windings of electrical multiphase motors.

In this connection, it is especially advantageous if, to hold a plug-in jumper in the bottom part or in the top part of the connection arrangement, a recess is formed especially such that touching of electrically conductive parts of the plug-in jumpers or mechanical influence on the plug-in jumpers in their mounting position is not easily possible.

In another configuration of the connection arrangement in accordance with the invention, it has proven advantageous if the fastening means in the bottom part is made in the form of clamp which enables clamping of the device-side cable without the aid of a tool. This simplifies the connection process at poorly accessible locations, mainly where it is not possible to work with both hands, for example, one hand must be used for positioning.

In another advantageous configuration of the invention, the top part is formed of several top part segments, each top part segment having at least one contact body and being connectable separately to the bottom part. The individual top parts can be connected to one another as a terminal block.

In another advantageous configuration of the electrical connection arrangement, the top part can be locked to the bottom part or each top part segment can be locked to the bottom part in the joined position, especially by catch elements which are assigned to the top part and the top part segment and which in the joined position can be caused to engage the corresponding catch element recesses in the bottom part of the connection arrangement. Especially preferably the catch element and the catch element recess are made such that when the bottom part and the top part or the bottom part and the top part segment are joined, they act exactly like a guide, and thus, ensure exact positioning of the first contact device relative to the device-side cable which is fixed in the fastening means of the bottom part and as a result ensure reliable contact-making.

In particular, there is now a host of possibilities for embodying and developing the electrical connection arrangement in accordance with the invention. In this regard, reference is made to the following detailed description of several embodiments in conjunction with the accompanying drawings.

DETAILED DESCRIPTION OF THE INVENTION

The electrical arrangement in accordance with the invention is described below for connection of an electric motor using several preferred embodiments. The invention could also be equally well described using other applications for connection of other electrical devices; the electrical connection arrangement in accordance with the invention is completely independent of the special application and function of the electrical device which is to make contact with the electrical connection arrangement.

Figure 1:
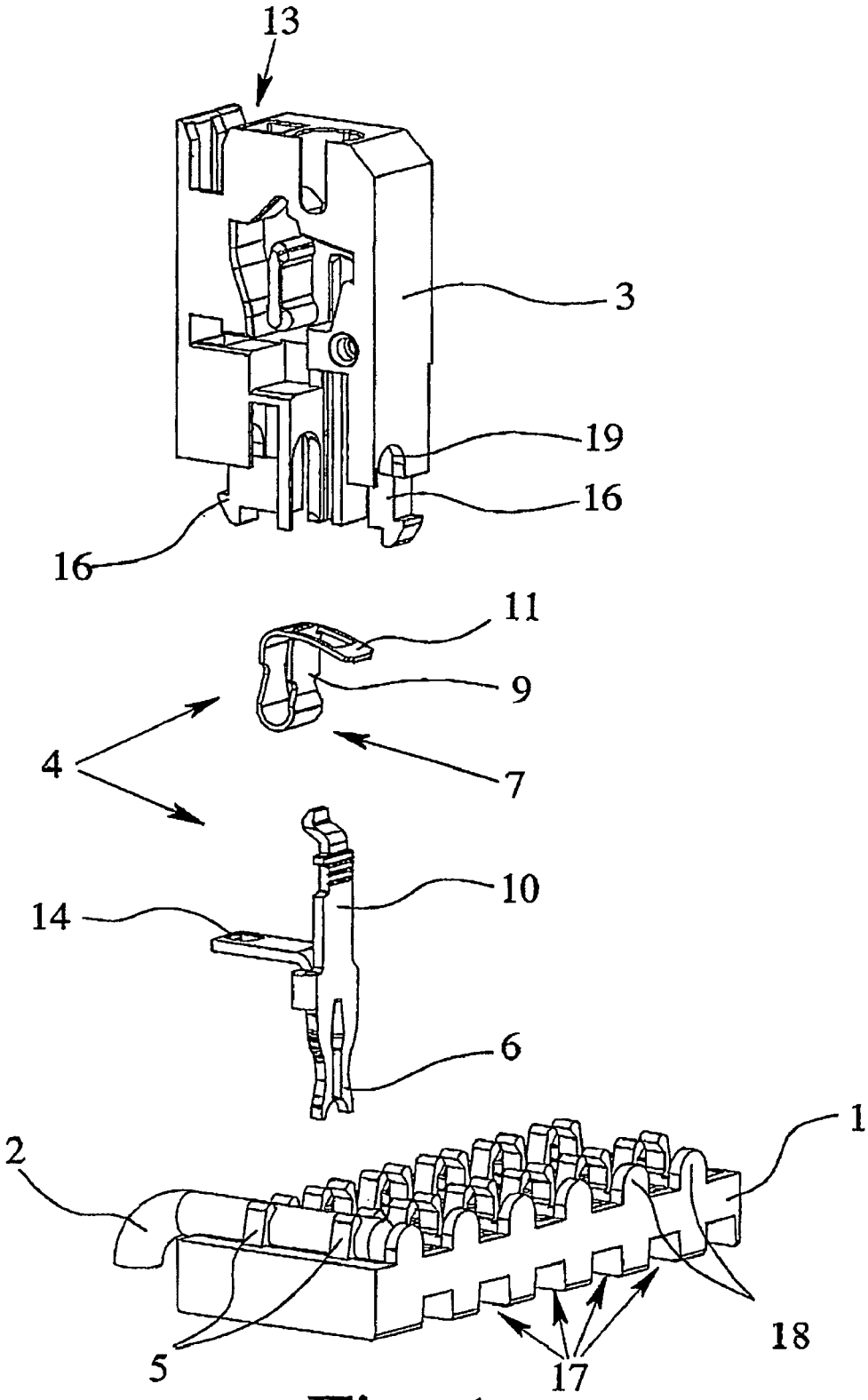
FIG. 1 is an exploded view of a preferred embodiment of the connection arrangement in accordance with the invention.

FIG. 1 shows, in an exploded view using one preferred embodiment, the important components of the connection arrangement in accordance with the invention, having a bottom part 1 which is used to hold the device-side cable 2, a top part 3 for holding a connection-side cable (not shown here) and a contact body 4 by which an electrical connection is established between the device-side cable 2 and the connection-side cable. Furthermore, the bottom part 1 is provided with fastening means 5 with which the device-side cable 2 can be fixed on or in the bottom part 1. The fastening of the device-side cable 2 in the bottom part 1 using the fastening means 5 takes place without electrical contact-making of the device-side cable 2.

The contact body 4 is assigned to the top part 3 and is fixed according to its function in the top part 3 in its installation position; this is shown in FIGS. 3, 5, 7 and 9. The contact body 4 is located in the top part 3 such that the contact body 4, with a first contact device 6, makes contact with the device-side cable 2 fastened in the bottom part 1 in the joined position of the bottom part 1 to the top part 3. The joined position of the bottom part 1 and of the top part 3 is shown in turn in FIGS. 3, 5, 7 and 9. The contact body 4 has a second contact device 7, 8 via which the connection-side cable can be electrically connected to the contact body 4 and can be adequately fastened mechanically to the contact body 4 so that the electrical connection is also ensured under the action of certain withdrawal forces on the connection-side cable.

In all the illustrated embodiments, the first contact device 6 is made as an insulation piercing contact. The special advantage of using a first contact device 6 made as an insulation piercing contact in conjunction with the connection arrangement in accordance with the invention is that the device-side cable 2 need not be released for making contact, so that handling of the device-side cable 2 when it is attached to the bottom part 1 of the connection arrangement with the fastening means 5 is safely possible.

Figure 3:
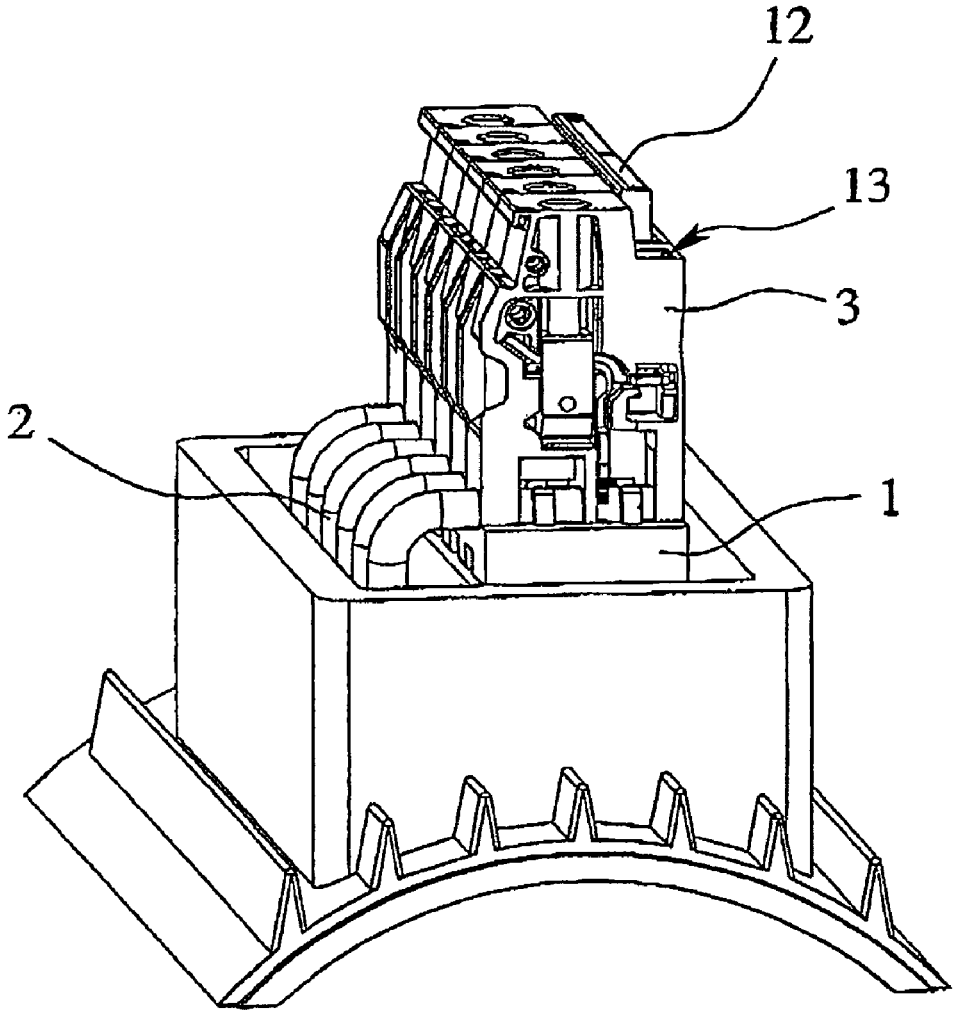
FIG. 3 is a perspective view of another embodiment of the connection arrangement in accordance with the invention in the installed state.
Figure 4:
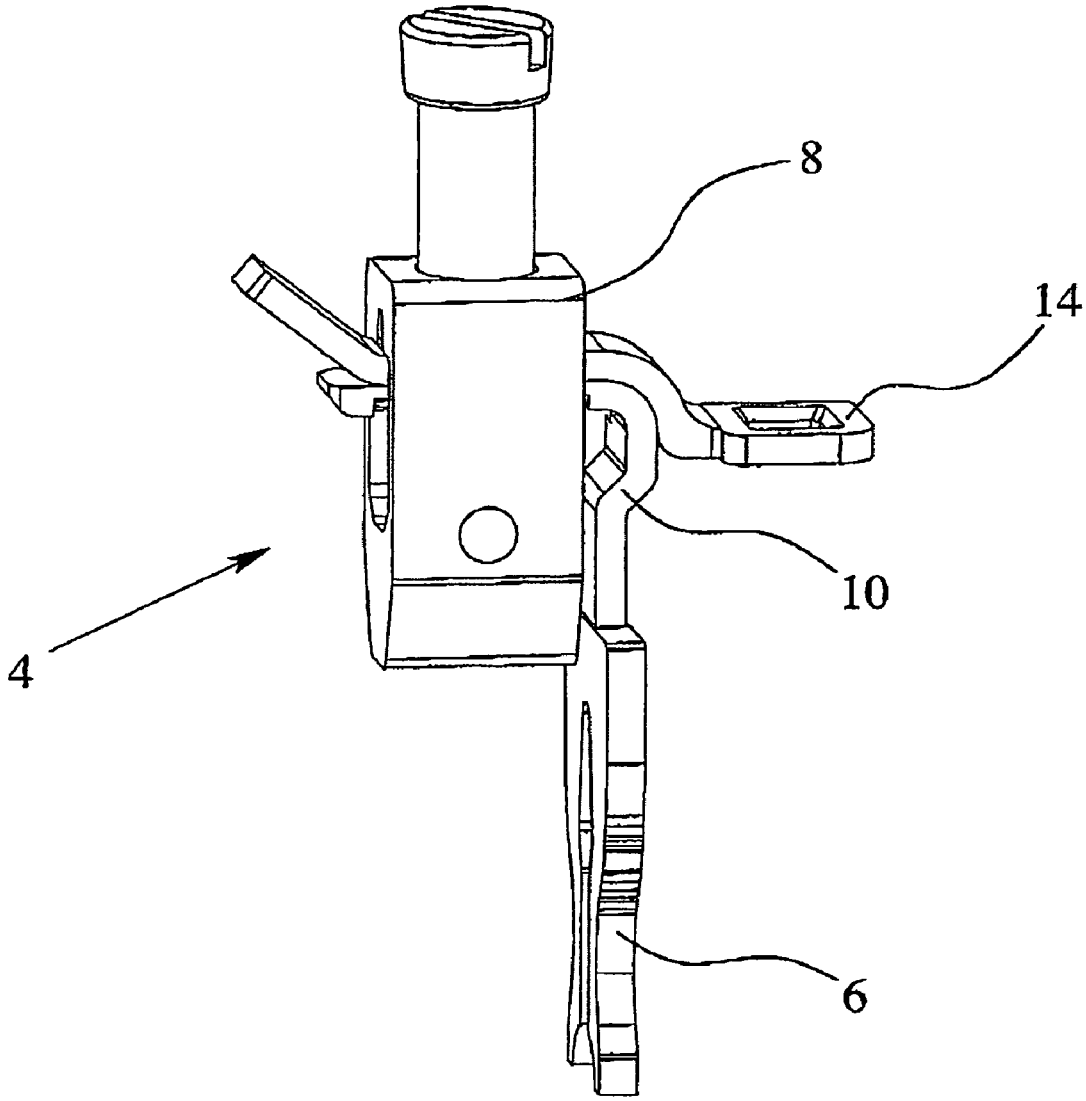
FIG. 4 shows a detail of the contact body as used in the embodiment shown in FIG. 3.
Figure 5:
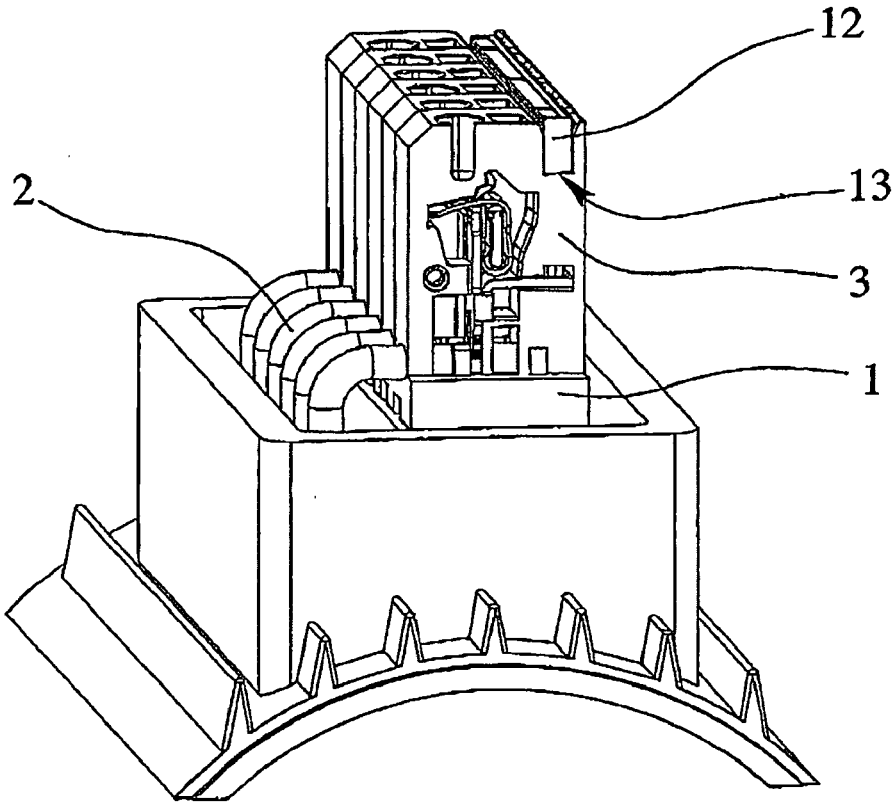
FIG. 5 is a perspective view of a third embodiment of the connection arrangement in accordance with the invention in the installed state.

The second contact device 7, 8 of the contact body 4 can be made fundamentally in any way. FIGS. 1 & 5 through 10 each show embodiments using spring force terminals 7 and FIGS. 3 & 4 show an embodiment using a screw-type terminal 8 as the second contact device. The connection arrangement in accordance with the invention is, however, not limited to these versions, but also other connection techniques can also be used.

In FIGS. 1 & 5 to 10, the spring force terminals 7 are made in the conventional manner as tension springs bent in a loop shape, with a contact leg 9 for contact with a conductor bar 10 and with a spring leg 11 with a free end bent in the direction of the contact leg 9, the free end of the contact leg 9 movably penetrating an opening in the spring leg 11. FIGS. 1, 5, 6, 9 and 10 show embodiments in which the spring leg 11 of the spring force terminals 7 is facing the insertion direction of the connection-side cable. In the figures, the spring-force terminal is shown in its deflected, opened position which can be induced by the action of an external force, for example, by actuating the spring force terminal 7 with an actuating tool. The actuating tool is conventionally guided onto the spring force terminal 7 via an actuating opening in the top part 3 of the connection arrangement.

Figure 7:
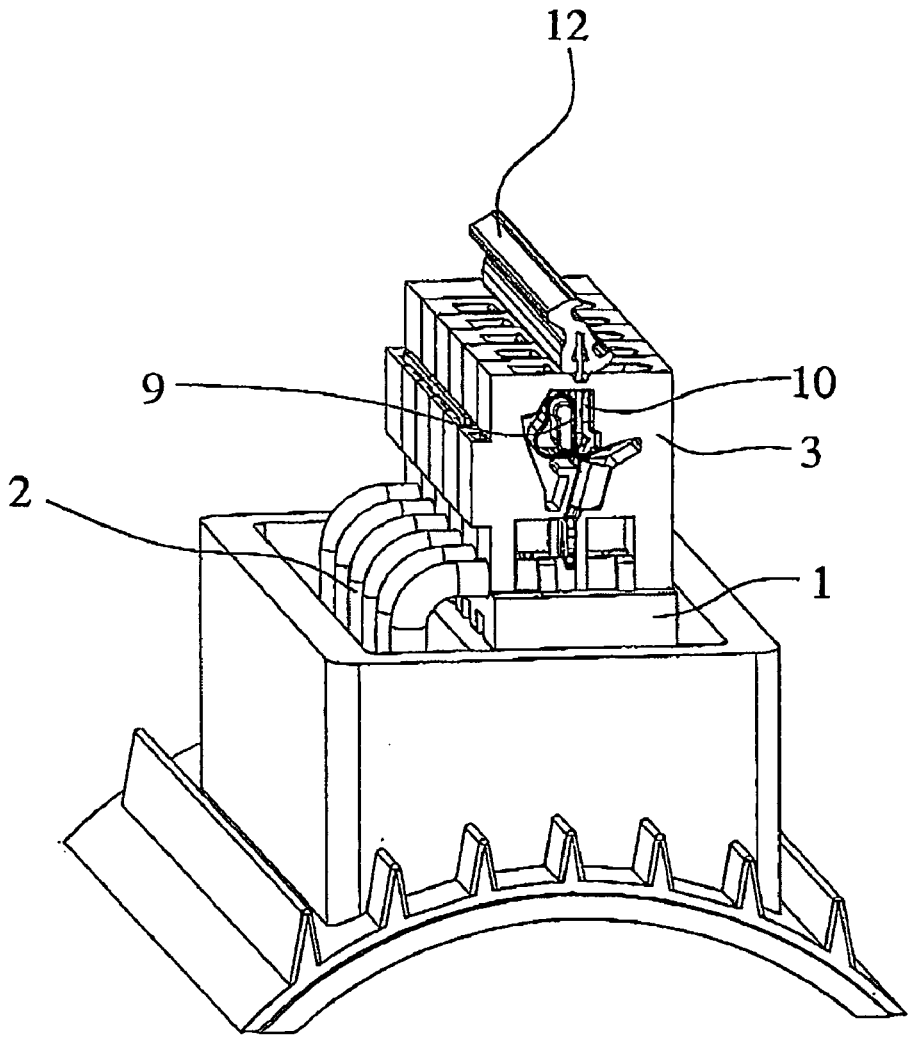
FIG. 7 is a perspective view of a fourth embodiment of the connection arrangement in accordance with the invention in the installed state.
Figure 8:
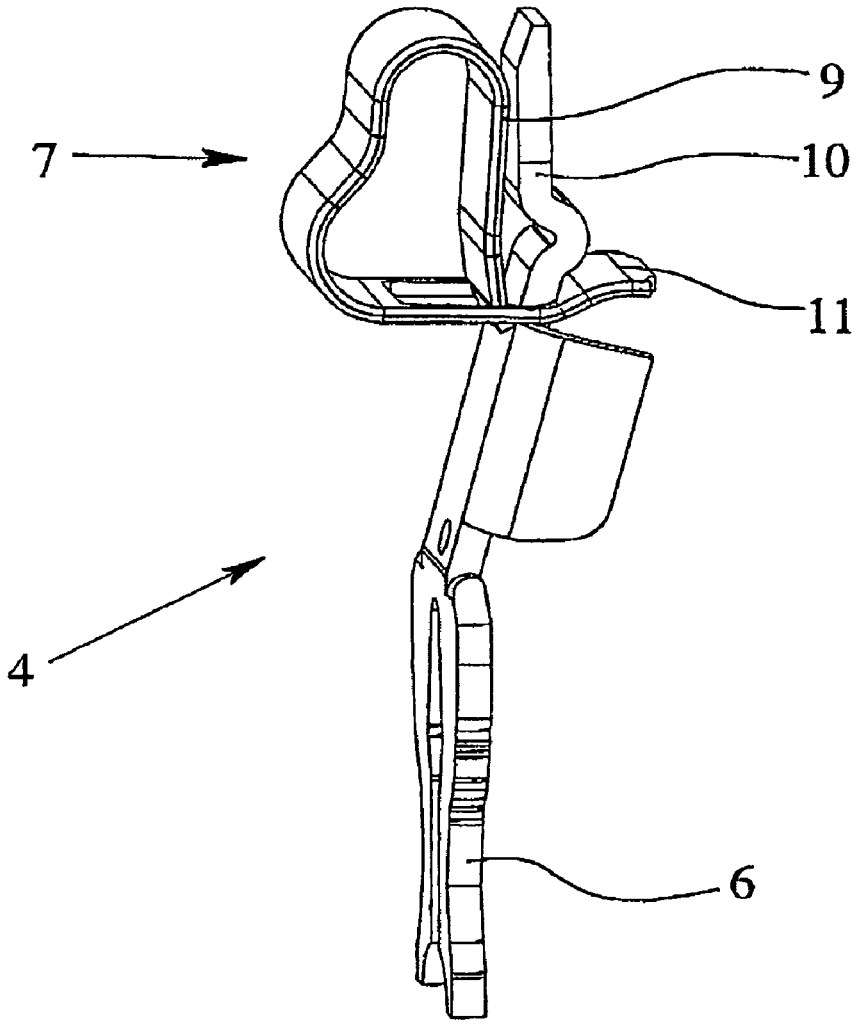
FIG. 8 shows a detailed representation of the contact body as used in the embodiment as shown in FIG. 7.

In another embodiment as shown in FIGS. 7 & 8, the spring force terminal 7 is bent in a loop shape with its spring leg 11 facing away from the insertion direction of the connection-side cable is located in the top part 3 of the connection arrangement. The operating principle is comparable to that of the above described spring force terminal 7, but the configuration of the spring force terminal 7 as shown in FIGS. 7 & 8 allows a more compact construction of the top part 3 than is possible in the above described embodiments.

In other embodiments which are not shown here, the spring force terminal is made as a locking hook spring which is bent in a U-shape and in which the conductor to be clamped is pressed against the conductor bar by the free end of the spring leg and blocks the conductor in the withdrawal direction.

Figure 9:
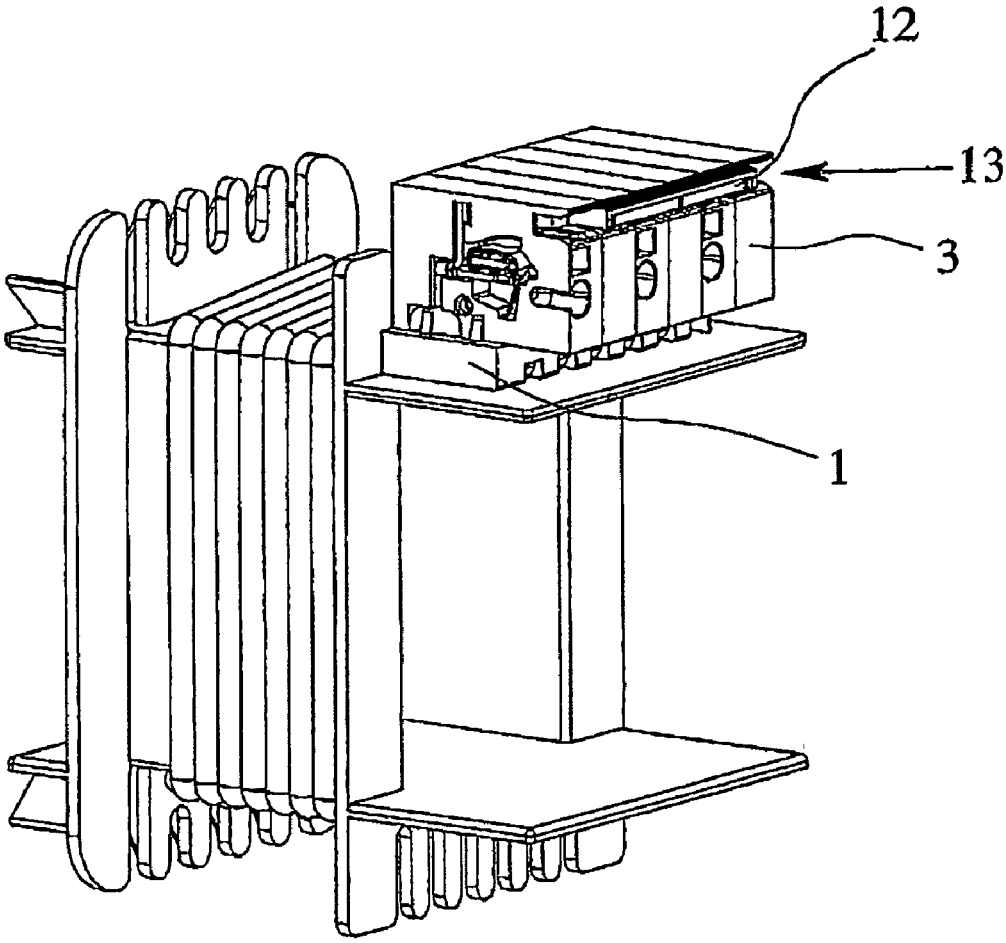
FIG. 9 is a perspective view of another embodiment of the connection arrangement in the installed state.
Figure 10:
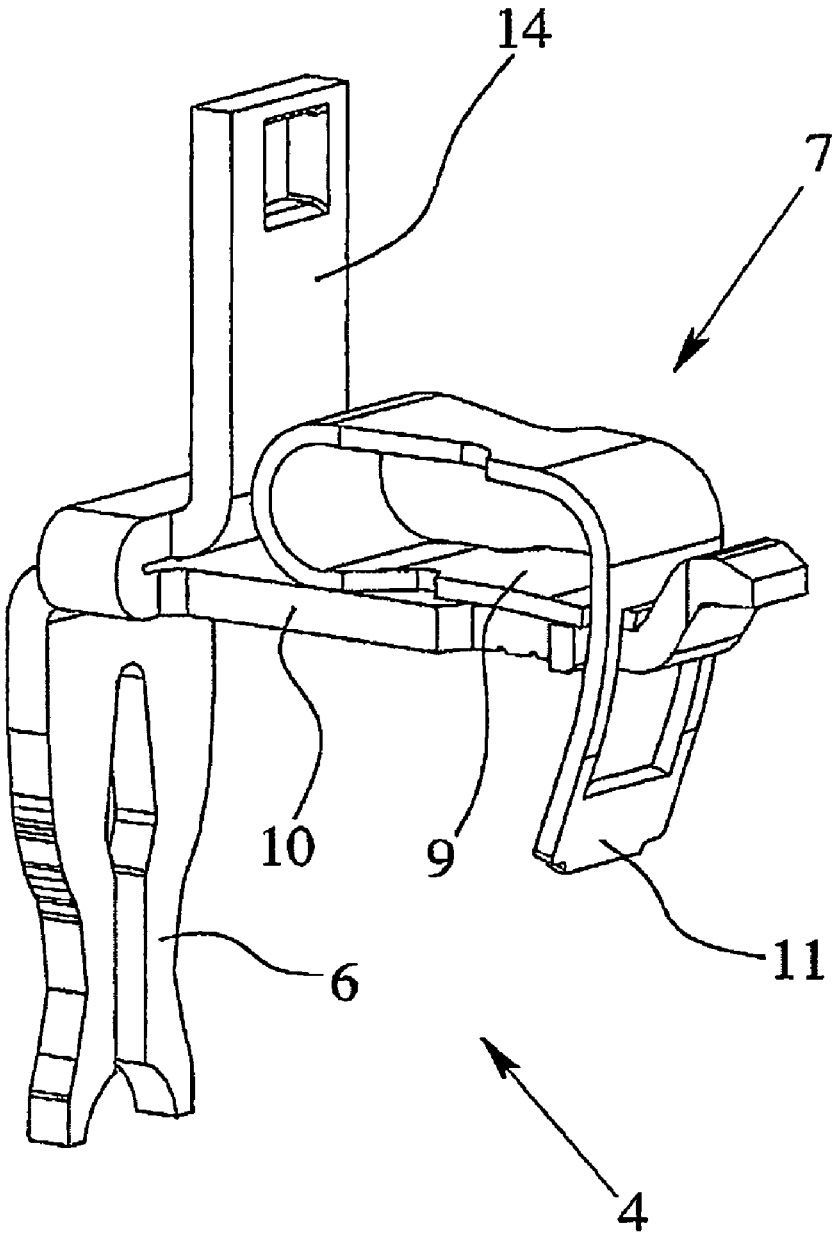
FIG. 10 shows a detailed representation of the contact body of the connection arrangement as shown in FIG. 9.

In the embodiment as shown in FIGS. 9 & 10, the contact body 4 is not extended essentially in a straight line, as in the other illustrated embodiments, but the contact leg 9 of the spring force terminal 7 and the conductor bar 10 are arranged bent essentially at a right angle relative to the first contact device 6, by which an altogether flatter construction, measured from the bottom 1 of the connection arrangement, is achieved.

Figure 6:
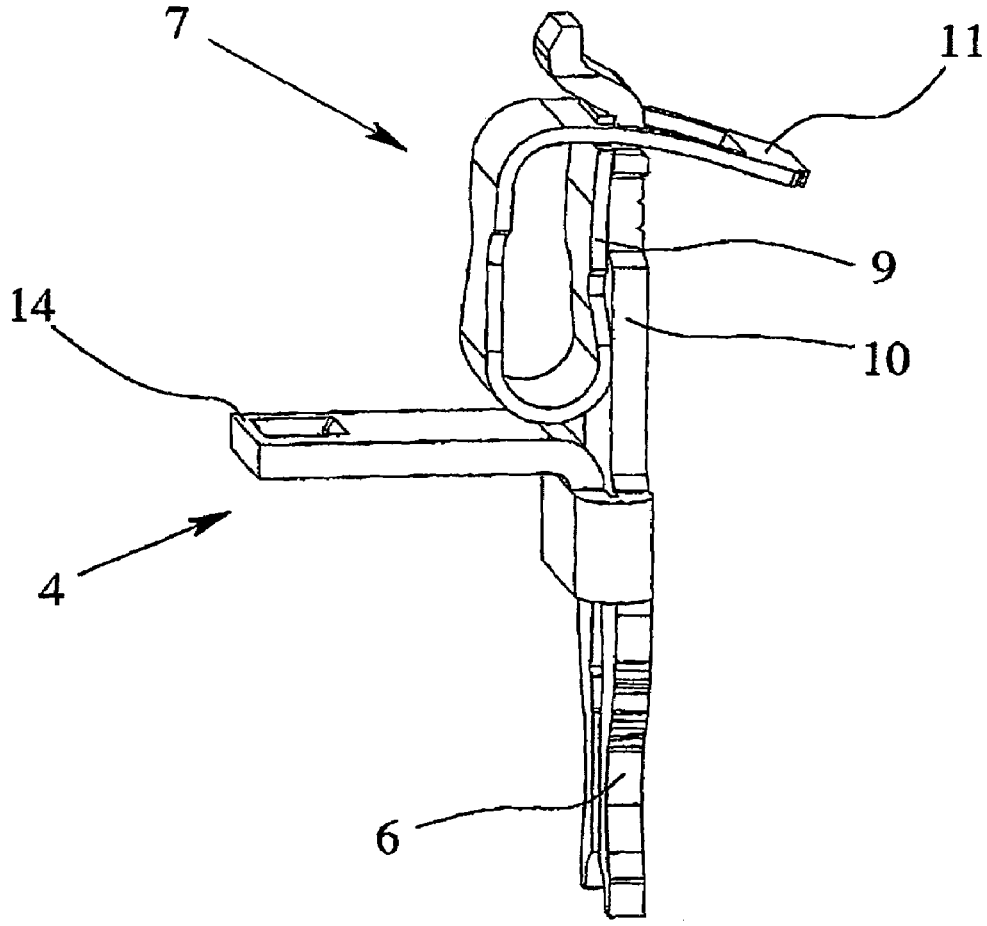
FIG. 6 shows a detailed representation of the contact body as used in the embodiment as shown in FIG. 5.

In all the illustrated embodiments, the contact body 4 is always made such that it can hold one leg of a plug-in jumper 12. To do this, the contact body 4, in the embodiments as shown in FIGS. 1, 6 and 10, is made such that a contact leg 14 is molded to it which uses an opening for holding a preferably elastically or conically made leg of one plug-in jumper 12. In the embodiment as shown in FIGS. 3 & 4, the contact leg 14 is not molded onto the contact body 4, but is inserted into the screw-type terminal 8 of the contact body 4, reliable contact being established between the screw-type terminal 8, the conductor bar 10 and the contact leg 14 by tightening the screw-type terminal 8. The embodiment as shown in FIGS. 7 & 8 is especially advantageous in this connection. The special orientation of the spring force terminal 7 with respect to the insertion direction of the connection-side cable makes it possible for the leg of the plug-in jumper 12 to be inserted between the contact leg 9 and the conductor bar 10 so that no further construction measures are necessary to produce electrical contact between the contact body 4 and the leg of the plug-in jumper 12.

As is shown in FIGS. 1, 3, 5 and 9, to hold the plug-in jumper 12 a recess 13 is formed in the top part 3 of the connection arrangement. On the one hand, this reduces or precludes the danger of unintentional electrical contact with the conductive parts of the plug-in juniper 12, and on the other, minimizes the danger of inadvertent removal of the plug-in jumper 12 from the top part 3 of the connection arrangement.

Figure 2A:
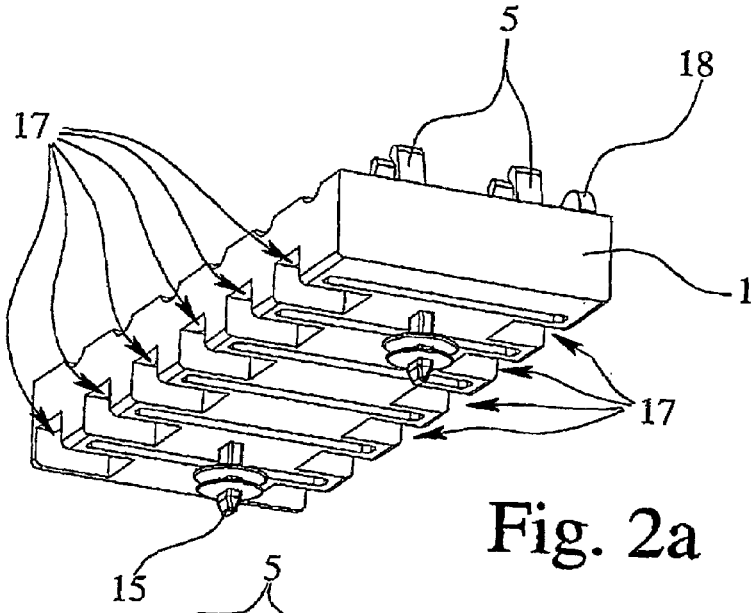
FIGS. 2*a* & 2*b* are bottom side and top side perspective views of the bottom part of one embodiment of the connection arrangement in accordance with the invention.
Figure 2B:
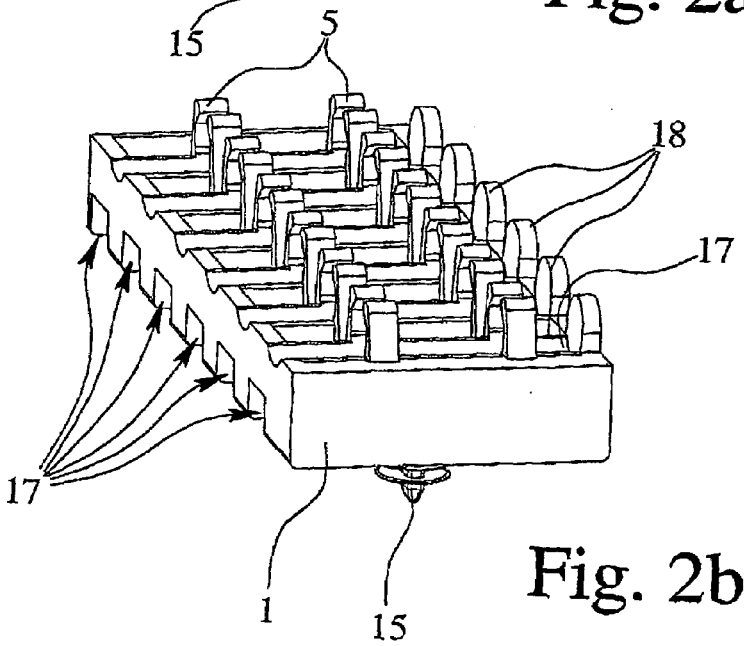

FIGS. 2*a* & 2*b* show the bottom part 1 of the connection arrangement separately. The fastening means 5 which is used to attach the device-side cable 2 in the bottom part 1 is formed here as a pair of clamps. In the embodiment shown, the fastening means 5 is formed in the bottom part 1, and in this respect is made of the same insulating material as the entire bottom part 1. Especially good fastening of the device-side cable 2 by the fastening means 5 is achieved when the bottom part 1, is trough-shaped in the area of the cable receiver so that the device-side cable 2 rests not only flat on the bottom part 1, but at least in areas is surrounded by the bottom part 1. In these embodiments, the fastening means 5 which are made as clamps are elastic such that the device-side cable 2 to be fixed by them can be pressed into the fastening means 5 without a tool.

All these embodiments of the connection arrangement in accordance with the invention show a modular top part 3 formed of several top part segments which lie next to one another in the manner of disks. In the illustrated embodiments, each top part segment has a contact body 4. The individual top part segments can be attached to one another, for example, by a fixing rod (not shown) and which is guided through the corresponding holes in the top part segments of the top part. In another embodiment, fixing is produced by corresponding keys and grooves or by the corresponding locking pins and locking recesses which are provided on the sides of each top part segment and can be connected to one another into a block via the adjacent top part segments.

According to FIGS. 2*a* & 2*b*, the bottom part 1 of the connection arrangement also has other fastening means 15 with which the bottom part 1 can be attached to the mounting surface. In this embodiment, the other fastening means 15 is made as a latch pin which can be inserted into the mounting wall for fixing purposes. In other embodiments (not shown), the other fastening means 15 have at least one screw receiver—through hole—or a top-hat rail receiver for attaching the electrical connection arrangement to the top-hat rail.

The described embodiments of the electrical connection arrangement all have the advantage of an especially simple and reliable electrical connection of electrical devices, due to the arrangement of the contact body 4 in the top part 3 of the connection arrangement and the contact-making of the contact body 4 with the device-side cable 2 which can be attained in this way when the bottom part 1 and the top part 3 are joined.

To ensure the mechanical connection between the bottom part 1 and the top part 3 of the connection arrangement, as shown in FIG. 1, the bottom part 1 and the top part 3 or the bottom part 1 and the individual top segments can be locked to one another; this is done in the embodiment as shown in FIG. 1 by catch elements 16 on the top part 3 and the corresponding catch element receivers 17 in the bottom part 1. The catch connection which can be produced via the catch element 16 and the corresponding catch element receiver 17 with as much free of play as possible exactly when the bottom part 1 and the top part 3 of the connection arrangement are moved completely into their joined position.

The connection arrangement as shown in FIG. 1 is, moreover, made such that the bottom part 1 and the top part 3 have the corresponding guide means 18, 19 which force specific joining motion of the top part 3 relative to the bottom part 1 when joined together so that reliable contact-making of the device-side cable 2 fixed in the bottom part 1 is ensured by the contact device 6 of the contact body 4 which is made as an insulation piercing contact. The guide means 18, 19 can also be made as a guide pin and guide pin receiver. Alternatively, the catch connection 16, 17 can also assume the function of the guide means 18, 19 at the same The bottom part 1 of the connection arrangement in these embodiments is made such that it can accommodate altogether six top part segments, by which especially the connection of three-phase motors is advantageously possible.

What is claimed is:

1. Electrical connection arrangement for electrical connection of an electrical device, comprising:

a bottom part for holding at least one device-side cable that is formed essentially of an electrically insulating material, a top part for holding at least one connection-side cable formed essentially of an electrically insulating material and a contact body for electrical connection of the device-side cable to the connection-side cable, wherein at least one fastening means is formed in the bottom part for fastening at least one device-side cable, wherein the contact body is located in the top part and has a first contact device and a second contact device, and wherein, in the joined position of the bottom part to the top part, the contact body makes contact with the device-side cable with the first contact device, and can make contact with the connection-side cable with the second contact device, wherein the second contact device of the contact body is one of a spring force terminal and a screw-type terminal, and wherein at least one recess for holding at least one plug-in jumper is located in at least one of the bottom part and the top part.

2. Electrical connection arrangement in accordance with claim 1, wherein the top part is formed of individual modular top part segments, each top part segment comprising at least one contact body.

3. Electrical connection arrangement in accordance with claim 1, wherein the bottom part has at least one other fastening means with which the bottom part is attachable to the mounting surface, the other fastening means being made as one of a screw receiver, top-hat rail receiver and a catch pin.

4. Electrical connection arrangement in accordance with claim 1, wherein the bottom part is lockable to the top part in the joined position.

5. Electrical connection arrangement in accordance with claim 1, wherein the bottom part and the top part have corresponding guide means by which the bottom part and the top part are movable in a guided manner into the joined position.

6. Electrical connection arrangement in accordance with claim 1, wherein the first contact device of the contact body is made as an insulation piercing contact.

7. Electrical connection arrangement in accordance with claim 6, wherein the second contact device of the contact body is one of a spring force terminal and a screw-type terminal.

8. Electrical connection arrangement for electrical connection of an electrical device, comprising:

a bottom part for holding at least one device-side cable that is formed essentially of an electrically insulating material, a top part for holding at least one connection-side cable formed essentially of an electrically insulating material and a contact body for electrical connection of the device-side cable to the connection-side cable, wherein at least one fastening means is formed in the bottom part for fastening at least one device-side cable, wherein the contact body is located in the top part and has a first contact device and a second contact device, wherein, in the joined position of the bottom part to the top part, the contact body makes contact with the device-side cable with the first contact device, and can make contact with the connection-side cable with the second contact device, wherein the contact body can accommodate one leg of a plug-in jumper by making electrical contact, and wherein the contact body has a contact leg, an opening being formed in the contact leg for receiving the leg of the plug-in jumper.

9. Electrical connection arrangement in accordance with claim 8 wherein the fastening means comprises at least one clamp located in the bottom part into which the device-side cable is insertable by pressing.

* * * * *